US010334941B2

(12) United States Patent
Hanneken et al.

(10) Patent No.: US 10,334,941 B2
(45) Date of Patent: Jul. 2, 2019

(54) BOTTLE BRUSH WITH MULTIPLE BRISTLE REACHES

(71) Applicant: HANDI-CRAFT COMPANY, St. Louis, MO (US)

(72) Inventors: Douglas Hanneken, St. Louis, MO (US); Xiangwen Zhang, Ellisville, MO (US); Idus L. Rhodes, II, St. Louis, MO (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 15/458,159

(22) Filed: Mar. 14, 2017

(65) Prior Publication Data

US 2017/0265636 A1 Sep. 21, 2017

Related U.S. Application Data

(60) Provisional application No. 62/308,600, filed on Mar. 15, 2016.

(51) Int. Cl.

| | |
|---|---|
| ***A46B 9/02*** | (2006.01) |
| ***A46B 9/06*** | (2006.01) |
| ***A46B 15/00*** | (2006.01) |
| ***A46B 5/00*** | (2006.01) |
| ***A46B 17/08*** | (2006.01) |

(52) U.S. Cl.

CPC ..... *A46B 9/06* (2013.01); *A46B 5/00* (2013.01); *A46B 9/02* (2013.01); *A46B 15/0097* (2013.01); *A46B 17/08* (2013.01); *A46B 2200/3006* (2013.01)

(58) Field of Classification Search

CPC ..... A46B 15/0097; A46B 2200/3006; A46B 9/02; A46B 9/06; A46B 9/028; A46B 2200/30; A46B 2200/104; A46B 5/00

USPC ..... 15/164, 211, DIG. 5, 114, 213, 65, 71, 15/74–75, 207.2

See application file for complete search history.

(56) References Cited

U.S. PATENT DOCUMENTS

| | | | | |
|---|---|---|---|---|
| 2,326,811 A * | 8/1943 | Wiggam | ..... | C08L 1/28 106/178.1 |
| 5,491,863 A * | 2/1996 | Dunn | ..... | A46B 3/18 15/106 |
| D375,595 S | 11/1996 | Shumway et al. | | |

(Continued)

FOREIGN PATENT DOCUMENTS

| | | |
|---|---|---|
| CN | 202366917 U | 8/2012 |
| CN | 103584816 A | 2/2014 |

(Continued)

*Primary Examiner* — Laura C Guidotti

(74) *Attorney, Agent, or Firm* — Armstrong Teasdale LLP

(57) ABSTRACT

A bottle brush includes a handle and a brush head connected to the handle. The brush head has a longitudinal axis and further includes a barrel having a sidewall substantially parallel to the longitudinal axis. A first row of bristles extends from the sidewall at least in part transversely from the barrel to define a first bristle reach. At least two second rows of bristles extend from the sidewall at least in part transversely from the barrel to define a second bristle reach different from the first bristle reach. The at least two second rows of bristles may be spaced longitudinally from each other with the first row of bristles being longitudinally intermediate to the second rows of bristles.

18 Claims, 4 Drawing Sheets

(56) References Cited

U.S. PATENT DOCUMENTS

| | | | | |
|---|---|---|---|---|
| D408,106 | S | 4/1999 | Cousins et al. | |
| D436,703 | S | 1/2001 | Finamore | |
| 6,202,247 | B1 | 3/2001 | Lorenz, Jr. | |
| 6,349,443 | B1 | 2/2002 | Randolph et al. | |
| D489,536 | S | 5/2004 | Dunn | |
| 7,017,222 | B2 | 3/2006 | Dunn | |
| 7,260,862 | B1 | 8/2007 | DeFilippis | |
| D625,924 | S * | 10/2010 | Juergens | D4/128 |
| D663,530 | S | 7/2012 | Duwa | |
| D683,544 | S | 6/2013 | Duwa | |
| D690,945 | S | 10/2013 | Williams et al. | |
| 2007/0119011 | A1* | 5/2007 | Ho | A46B 5/0062 15/172 |
| 2007/0274762 | A1* | 11/2007 | Edwards | A46B 5/0016 401/39 |
| 2008/0201881 | A1 | 8/2008 | Dunn et al. | |
| 2014/0013529 | A1 | 1/2014 | Kilgore et al. | |
| 2016/0249733 | A1* | 9/2016 | Tebbe | A46B 5/0037 15/143.1 |

FOREIGN PATENT DOCUMENTS

| | | | | |
|---|---|---|---|---|
| DE | 19515307 | A * | 10/1996 | A46B 3/18 |
| JP | 2004-121646 | A * | 4/2004 | A47L 13/10 |
| WO | 2014137339 | A1 | 9/2014 | |

* cited by examiner

BOTTLE BRUSH WITH MULTIPLE BRISTLE REACHES

CROSS-REFERENCE TO RELATED APPLICATIONS

This patent application relates to and claims priority to U.S. provisional patent application Ser. No. 62/308,600 filed Mar. 15, 2016, which is hereby incorporated by reference in its entirety.

FIELD

The field of this invention relates generally to bottle brushes and more particularly to bottle brush suitable for use with multiple bottles of differing sizes and dimensions, such as bottles with differing neck dimensions.

BACKGROUND

Bottle brushes, such as those for cleaning infant or nursing bottles, generally include a handle, a neck extending from the handle, a head disposed on the neck, and a plurality of bristles extending from the brush head. During use the bristles are made to contact and abrade outer and inner surfaces of a bottle to remove dirt, food, and other material. Cleaning the inner surface of a bottle generally requires inserting the head and bristles into the bottle.

A bottle must be properly and thoroughly cleaned between uses to ensure the health and safety of users of the bottle, particularly if the bottle user is an infant or young child who may have underdeveloped immune systems. Absent proper cleaning, a bottle may harbor bacteria and similar harmful organisms that, if ingested or exposed to, may cause illness, infection, and similar harm.

Bottles are available in various shapes, sizes, and designs and many consumers own multiple bottles of different types. For example, among nursing bottles, it is common for bottles to have a standard size or what is commonly referred to as a "wide-neck" size. Bottle designs may include features that are difficult to clean absent use of a specially designed bottle brush having a shape, size, or bristle arrangement particularly configured to clean the features. Cleaning such bottles absent the proper bottle brush may be difficult and inefficient and may increase the likelihood that the bottle will not be properly cleaned and will harbor or encourage growth of harmful bacteria and the like. Accordingly, consumers are left with the choice of purchasing multiple brushes specifically designed for the bottles they own or spending extra time and effort to clean bottles using sub-optimal brushes.

In light of the foregoing, there is a need for a single bottle brush capable of properly and efficiently cleaning bottles of various sizes, shapes, and designs.

SUMMARY

In one aspect, a bottle brush comprises a handle and a brush head connected to the handle. The brush head has a longitudinal axis and further includes a barrel having a sidewall substantially parallel to the longitudinal axis. A first row of bristles extends from the sidewall at least in part transversely from the barrel to define a first bristle reach. At least two second rows of bristles extend from the sidewall at least in part transversely from the barrel to define a second bristle reach different from the first bristle reach. The at least two second rows of bristles may be spaced longitudinally from each other with the first row of bristles being longitudinally intermediate to the second rows of bristles.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
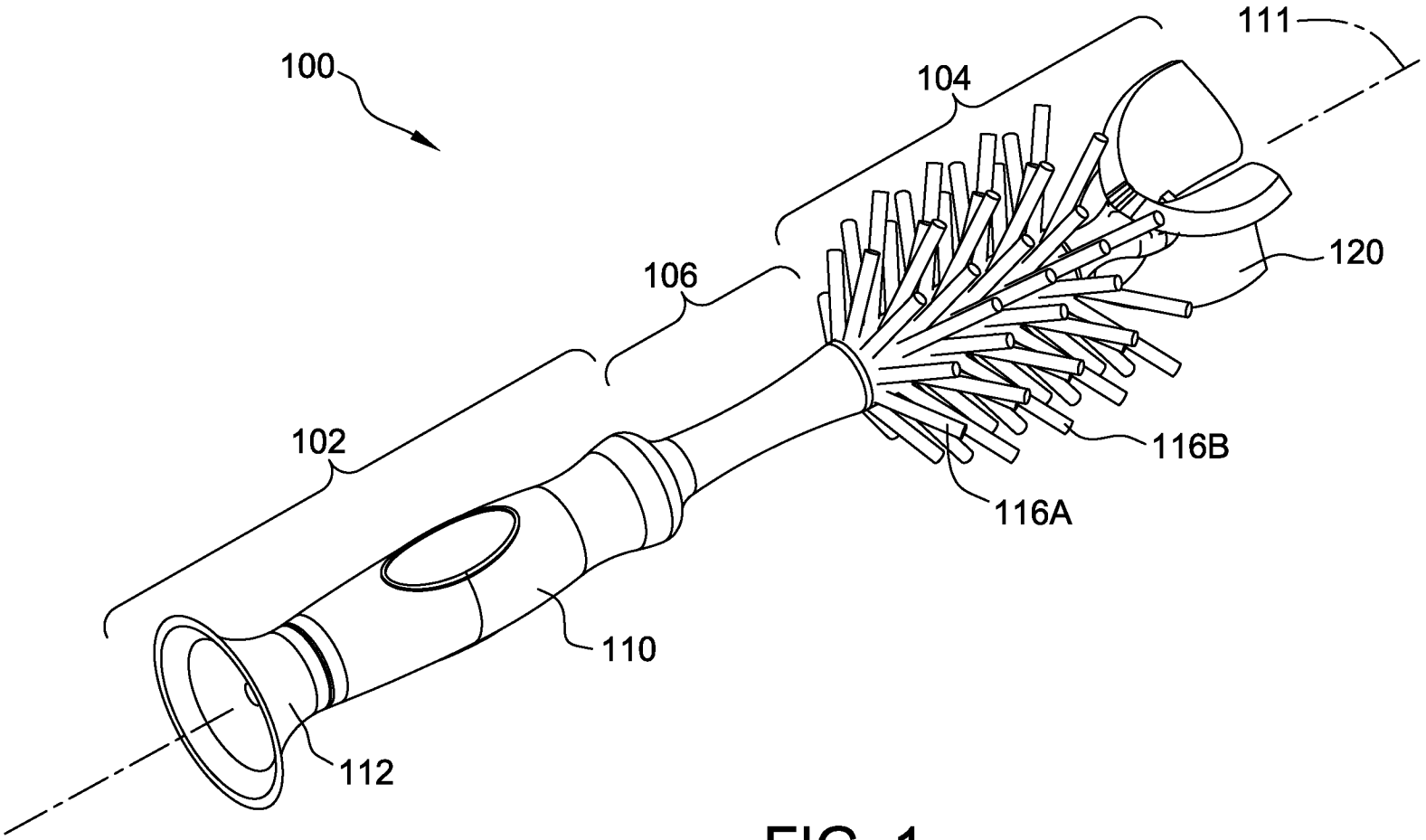
FIG. 1 is a perspective one embodiment of a bottle brush.
Figure 2:
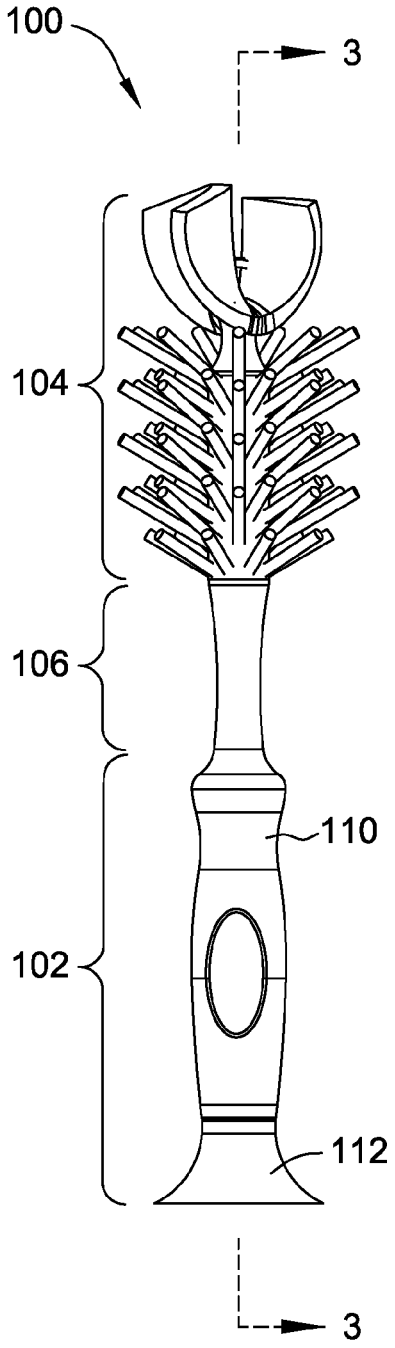
FIG. 2 is a view of the bottle brush of FIG. 1.
Figure 3:
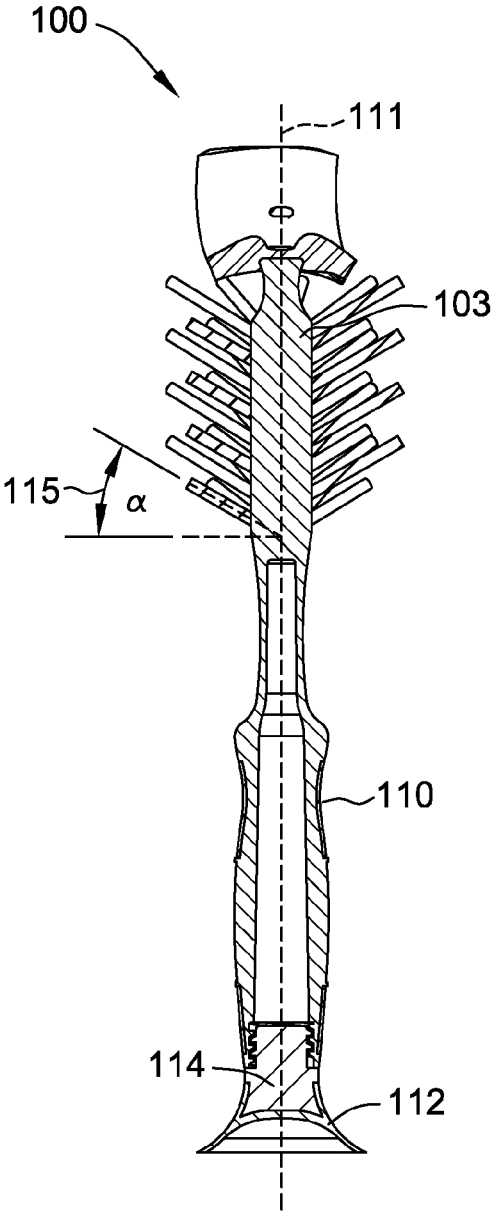
FIG. 3 is a cross-sectional view of the bottle brush of FIG. 1.

Referring now to the drawings and in particular to FIGS. 1-3, one embodiment of a bottle brush, generally indicated at 100, includes a handle 102 at a proximal end of bottle brush 100, a brush head 104 at a distal end of bottle brush 100, and a neck 106 connecting handle 102 to brush head 104. Disposed on the distal end of brush head 104 is a shaped tip 120. Handle 102 and neck 106 may be rigid or semi-rigid and may be solid or hollow in whole or in part.

Handle 102 may be covered in whole or in part by an outer grip 110. Outer grip 110 may be composed of a thermoplastic elastomer (TPE) or similar material selected to help a user maintain a grip on bottle brush 100 during use. Preferably, the material of outer grip 110 is chosen to enable gripping even when handle 102 and outer grip 110 are wet. In certain embodiments, outer grip 110 may include one or more sections having a textured outer surface to further assist a user in maintaining a grip on bottle brush 100 during use.

Outer grip 110 may be installed on handle 102 in several ways. For example, in certain embodiments, outer grip 110 may be overmolded directly onto handle 102. In other embodiments, outer grip 110 may be manufactured separately from handle 102 and may be installed on handle 102 by inserting handle 102 into outer grip 110.

Handle 102, brush head 104, and neck 106 may be aligned along a single longitudinal axis 111. In other embodiments, handle 102, brush head 104, and neck 106 may each have independent longitudinal axes that may be parallel but offset from each other or that may be disposed at an angle with respect to each other. Moreover, although handle 102, brush head 104, and neck 106 are substantially straight in bottle brush 100, other embodiments according to this disclosure may include curved or angled handles, brush heads, or necks.

A suction cup 112 or similar feature configured to enable a user to attach bottle brush 100 to a surface may be disposed on the proximal end of handle 102. Suction cup 112 permits bottle brush 100 to be attached to and extend normal to a surface to facilitate drying and to avoid exposing brush head 104 to bacteria and potentially harmful substances when bottle brush 100 is not in use. Suction cup 112 may be composed of TPE or other flexible or semi-rigid materials. As shown in FIG. 3, suction cup 112 may be attached to handle 102 by a threaded plug 114. Suction cup 112 and threaded plug 114 may be integrated into a single component. Alternatively, suction cup 112 and plug 114 may be separate components and suction cup 112 may be installed on threaded plug 114 by overmolding suction cup 112 onto threaded plug 114, inserting threaded plug 114 into suction cup 112, or any other suitable coupling.

Handle 102 may be connected to brush head 104 by neck 106. Brush head 104 generally includes a barrel 103 having a sidewall from which bristles extend. Bottle brush 100, for example, includes short bristles 116A and long bristles 116B. Bristles may be composed of one or more natural or synthetic materials including, but not limited to TPE, polyethylene, nylon, polypropylene, stainless steel, brass, natural plant or vegetable fibers, animal hair, and the like. The term "bristle" as used herein is intended to include singular bristles, as is generally the case with molded bristles, but also bristles formed by clusters of smaller bristle elements, as is generally the case with brushes having nylon bristles.

Short bristles 116A and long bristles 116B are depicted as having a substantially circular cross-section and as substantially cylindrical in overall shape. In other embodiments, bristles may have one or more cross-sections with varying shapes including, but not limited to square cross-sections, triangular cross-sections, oval cross-sections, hexagonal cross-sections, and the like.

Short bristles 116A and long bristles 116B may be fixed to barrel 103 in various ways. For example, in certain embodiments, short bristles 116A and long bristles 116B may be molded into barrel 103. In other embodiment, short bristles 116A and long bristles 116B may be retained in barrel 103 by a press, shrink, or other interference fit. Short bristles 116A and long bristles 116B may also be inserted into barrel 103 and held in place by metal or plastic holds anchored or glued in barrel 103.

In certain embodiments, bristles may be molded or otherwise created to size to achieve bristles of different lengths. Bristles of different lengths may also be created by manufacturing bristles having uniform length and trimming the bristles to size. Bristles may be trimmed to size before or after bristles are fixed into barrel 103.

Brush head 104 may include any number of rows of bristles. Bottle brush 100, for example, includes four rows of short bristles 116A and four rows of long bristles 116B arranged such that the rows of short bristles alternate with the rows of long bristles. Other embodiments may include more or fewer rows of either short bristles or long bristles and may include arrangements of rows of bristles other than alternation between rows of short and long bristles. For example, other embodiments may include an alternating pattern of two or more rows of short bristles and two or more rows of long bristles or may include a single row of short or long bristles longitudinally intermediate to two rows of long or short bristles, respectively.

For bottle brush 100, brush head 104, and more specifically barrel 103, is integrally formed with neck 106 and handle 102. In other embodiments, any of brush head 104, neck 106, and handle core 102 may be separate components fixedly coupled to each other by adhesives, a shrink fit, a press or interference fit, and the like. In still other embodiments, brush head 104, neck 106, and handle 102 may be selectively coupled to each other using threads, clips, or similar selective couplings. Such selective coupling allows removal and replacement of brush head 104, neck 106, or handle 102 with new brush heads, necks, or handles, permitting new brush configurations and allowing worn or damaged components to be replaced. For example, selectively coupling brush head 104 to neck 106 permits a user to replace brush head 104 in the event that the bristles or other components of brush head 104 wear or are otherwise damaged.

During use, bottle brush 100 is inserted into a bottle and moved within the bottle such that short bristles 116A and/or long bristles 116B are made to contact inner surfaces and features of a bottle. Many bottles include a narrowed neck portion onto which a nipple, collar, lid, cap, and the like may be affixed to the bottle. During removal of a bottle brush from such a bottle, the neck may deform the bristles by bending the bristles towards the distal end of the bottle brush. As the bristles clear the neck, the bristles may rapidly return to their original positions, causing any liquids or material disposed in or on the bristles to be scattered from the bristles into the surrounding area.

To reduce the potential for such scattering and to generally ease insertion and removal of bottle brush 100 into and out of a bottle, short bristles 116A and long bristles 116B may extend from the sidewall of barrel 103 at an angle relative thereto so as to extend in part transverse to and in part longitudinally of the longitudinal axis of the barrel. The angle of each bristle relative to the barrel is referred to herein as the bristle bias and is generally referenced relative to a plane transverse to the longitudinal axis of brush head 104. Accordingly, bristles having a greater bias are angled or "swept" to a greater degree toward the distal end of brush head 104 while those having less bias extend in a more transverse direction relative to the longitudinal axis of the barrel.

By applying a bias to short bristles 116A and long bristles 116B brush head 104 may be more readily removed from a bottle and scattering of liquid or material disposed on the brushes may be significantly reduced. Moreover, biasing bristles reduces the deformation experienced by short bristles 116A and long bristles 116B during removal from a bottle and, as a result, extends the useful life of bottle brush 100.

In FIG. 3, the bristle bias is indicated by angle $\alpha$ 115, which is the angle between a plane transverse to longitudinal axis 111 and the bristles. Both short bristles 116A and long bristles 116B are biased by angle $\alpha$ 115. Angle $\alpha$ 115 may have a value of 0-80 degrees, and is preferably 20-50 degrees. Bristles of bottle brushes according to this disclosure are not limited to a single bias. Rather, in certain embodiments, short bristles 116A may be biased at a different angle than long bristles 116B and individual rows of short bristles and long bristles may be biased at different angles than any other row of short bristles and long bristles.

Figure 4:
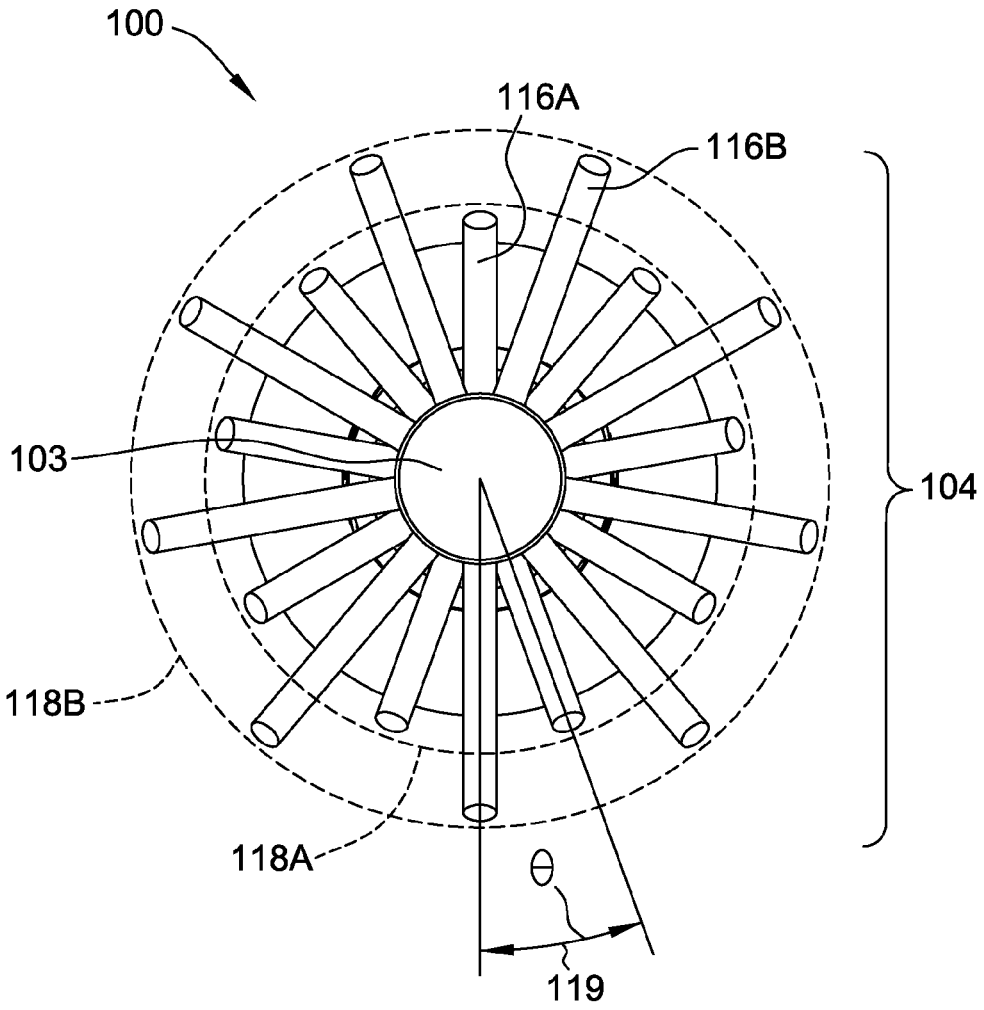
FIG. 4 is an end view of the brush head of the bottle brush of FIG. 1.

FIG. 4 is an end view of the distal end of brush head 104 with shaped tip 120 removed. As depicted in FIG. 4, short bristles 116A and long bristles 116B may generally define a first bristle reach 118A and a second bristle reach 118B, respectively. The term bristle reach is used herein to refer to the transverse extension of bristles from the barrel. Bristle reach depends on both the length and bias of the bristles in a row of bristles; however, multiple combinations of bristle length and bias may result in the same bristle reach. In the embodiment of FIG. 4, short bristles 116A and long bristles 116B are of uniform length and bias and disposed evenly around the circumference of barrel 103. As a result, first bristle reach 118A and second bristle reach 118B are substantially circular. In other embodiments, one or more of the length of the bristles, bias of the bristles, arrangement of the bristles, and the shape of the barrel may vary such that the bristle reach is non-circular. For example, bristle reaches may be square, ovate, triangular, hexagonal, and the like, or may be a line or arc.

Bristle reaches may be selected to more effectively clean particular bottle features. For example, in certain embodiments, first bristle reach 116A may correspond to a first feature, such as an inner surface, of a bottle while second bristle reach 118A may correspond to a second feature, such as a second inner surface, of the same bottle. In other embodiments, first bristle reach 118A may correspond to a first feature of a first bottle while second bristle reach 118B may correspond to a second feature of a second bottle. For example, first bristle reach 118A may correspond to a neck of a first bottle, such as a "standard neck" bottle, while second bristle reach 118B may correspond to a neck of a second bottle, such as a "wide-neck" bottle. For bottle brushes with bristle reaches selected based on bottle necks, the bristle reach is preferably equal to the radius of the bottle neck for which the brush is designed. In a preferred embodiment, short bristles 116A are sized and biased such that first bristle reach 118A is circular and has a radius of 0.5-1.20 in. while long bristles 116B are sized and biased such that second bristle reach 118B is also circular and has a radius of 1.20-2.00 in.

FIG. 4 further depicts adjacent rows of short bristles 116A and long bristles 116B being offset from each other. Specifically, both short bristles 116A and long bristles 116B are evenly distributed around barrel 103 with short bristles 116A being rotationally offset from long bristles 116B by angle θ 119. Offsetting adjacent rows of short bristles 116A and long bristles 116B minimizes the likelihood that short bristles 116A and long bristles 116B will interfere during use. For example, if first bristle reach 118A is sized to clean an inner surface of a bottle, long bristles 116B will be deformed or otherwise bent during actual cleaning of the inner surface because first bristle reach 118A would be less than second bristle reach 118B. If short bristles 116A and long bristles 116B were to be aligned, deformation of long bristles 116B may cause long bristles 116B to contact or otherwise interfere with short bristles 116A, impacting the ability of short bristles 116A to properly clean the inner surface. Accordingly, by offsetting adjacent rows of short bristles 116A and long bristles 116B, such interference is avoided.

The number and arrangement of bristles in bottle brushes according to this disclosure may vary. Bristles are generally arranged in adjacent rows with each row lying on a plane that is generally transverse to a longitudinal axis of the brush head. In the case of bottle brush 100, for example, head 104 is generally circular and short bristles 116A and long bristles 116B are arranged in adjacent rows comprising only short bristles and long bristles, respectively, with the bristles of each row distributed circumferentially around barrel 103.

Each row of bristles may include any suitable number of bristles arranged in any suitable distribution. Preferably, each row contains between 5 and 15 bristles. In bottle brush 100, for example, each row of bristles consists of either nine short bristles or nine long bristles evenly distributed around the circumference of barrel 103. In such a distribution, each short bristle and each long bristle is offset from bristles in the same row by approximately 40 degrees. In other embodiments, more or fewer bristles may be used on each row such that if the bristles remain evenly distributed, the offset between the bristles would increase or decrease, respectively. Although short bristles 116A and long bristles 116B are evenly distributed around the entire circumference of barrel 103, in other embodiments, bristles may not be evenly distributed around the barrel and/or may extend only from a portion of the brush head.

Barrel 103 of bottle brush 100 has a generally circular cross-section but other barrels may have other cross-sectional shapes. For example, barrels may have any of an ovate cross-section, a square cross-section, a triangular cross-section, a semi-circular cross-section, a generally flat cross-section, and the like. The manner in which bristles are arranged and offset from each other may depend on the cross-section of the barrel. For example, bristles of bottle brushes having square barrels may include rows of bristles in which sections of bristles extend parallel to each other. In such arrangements, the bristles may be offset linearly (as opposed to rotationally) from bristles in the same row or adjacent rows.

Embodiments described herein generally include two lengths of bristles: short bristles 116A and long bristles 116B. However, other embodiments in accordance with this disclosure may include more than two bristle types, including bristles of different lengths, materials, biases, and the like. To the extent a bottle brush includes more than two types of bristles, additional bristles may be configured to create additional bristle radii and may be offset from one or more other bristle types.

Figure 5:
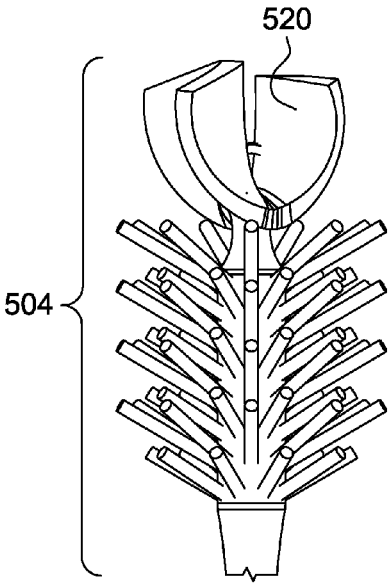
FIGS. 5-8 are detailed views of brush heads having different configurations.

FIGS. 5-8 depict various brush head configurations and, more specifically, brush heads having different brush head tips. As shown in FIG. 5, a brush head 504 may terminate in a shaped tip 520. Shaped tip 520 may be composed of TPE or a similar material and may be shaped to conform to a feature of a bottle. For example, during use, a bottle brush having head 504 with shaped tip 520 may be used to clean the bottom of a bottle by inserting the bottle brush into a bottle such that shaped tip 520 abuts the bottom of the bottle. By twisting the bottle brush, shaped tip 520 may be made to rub or abrade the bottom of the bottle to facilitate cleaning.

Figure 6:
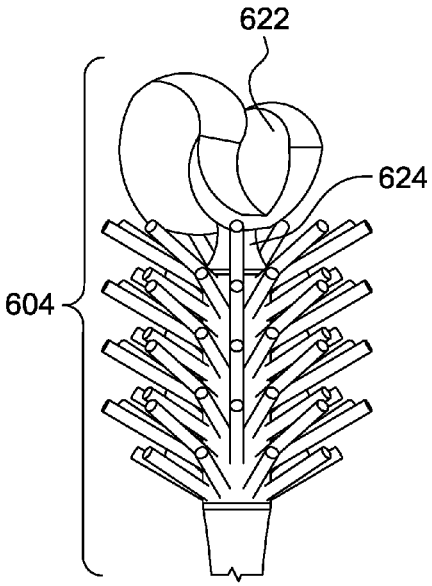

FIG. 6 depicts an embodiment in which a brush head 604 terminates in a sponge 622. To accommodate sponge 622, brush head 604 may include an extension 624 extending beyond bristles of head 604 and configured to retain sponge 622. In certain embodiments, extension 624 may include a loop of wire extending from the distal end of brush head 604 into which sponge 622 is inserted.

Figure 7:
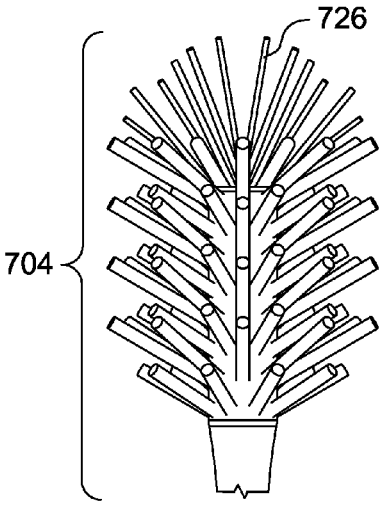

FIG. 7 depicts an embodiment in which a brush head 704 is terminated in a bristle tip 726. As shown, bristle tip 726 may have a generally rounded profile. Specifically, the bristles of bristle tip 726 may be arranged such that adjacent rows of bristles have increased biases towards the distal end of brush head 704. The bristles may also be trimmed or otherwise be of shorter length towards the distal end of brush head 704 to further define the rounded profile.

Figure 8:
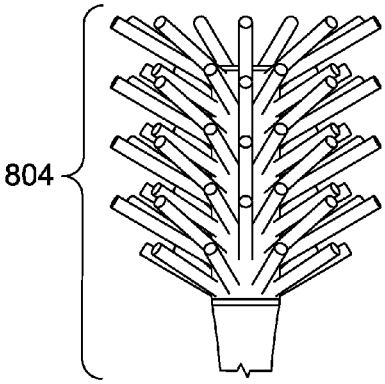

FIG. 8 depicts an embodiment in which a brush head 804 ends at the last row of bristles.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A bottle brush comprising:

a handle; and a brush head connected to the handle, the brush head having a longitudinal axis and further comprising a barrel having a sidewall substantially parallel to the longitudinal axis, a first row of bristles extending from the sidewall, wherein the first row of bristles is biased a first angle from a plane normal to the longitudinal axis to extend from the sidewall at least in part transversely from the barrel and at least in part longitudinally to define a first bristle reach, and at least two second rows of bristles extending from the sidewall, wherein the at least two second rows of bristles are each biased a same second angle from the plane normal to the longitudinal axis to extend from the sidewall at least in part transversely from the barrel and at least in part longitudinally, each of the second rows of bristles defining a second bristle reach different from the first bristle reach, the at least two second rows of bristles being spaced longitudinally from each other with the first row of bristles being longitudinally intermediate the second rows of bristles.

2. The bottle brush set forth in claim 1, wherein the barrel is circular and the first row of bristles and the second rows of bristles are each arranged circumferentially around the barrel.

3. The bottle brush set forth in claim 1 further comprising a plurality of first rows of bristles, wherein the plurality of first rows of bristles alternate with the at least two second rows of bristles.

4. The bottle brush set forth in claim 1, wherein the first row of bristles and the second rows of bristles extend from the sidewall at an angle approximately less than 80 degrees from a plane normal to the longitudinal axis.

5. The bottle brush set forth in claim 1, wherein the first bristle reach and the second bristle reach are circular, the first bristle reach having a radius of between approximately 0.50 and approximately 1.20 inches normal to the longitudinal axis and the second bristle reach having a radius between approximately 1.20 inches and approximately 2.00 inches normal to the longitudinal axis.

6. The bottle brush set forth in claim 1, wherein each of the first row of bristles and the second rows of bristles comprises between 5 and 15 bristles.

7. The bottle brush set forth in claim 1, wherein the first row of bristles is offset from each of the second rows of bristles.

8. The bottle brush set forth in claim 7, wherein the barrel is circular and the first row of bristles is rotationally offset from the second rows of bristles.

9. The bottle brush set forth in claim 1, wherein the handle includes a first end and a second end opposite the first end, the second end being coupled to the brush head, and the handle further comprises a suction cup coupled to the first end of the handle.

10. The bottle brush set forth in claim 1, wherein the handle comprises an overmolded outer grip.

11. The bottle brush set forth in claim 1, wherein the brush head includes a proximal end coupled to the handle and a distal end opposite the proximal end, and the brush head further comprises one of a shaped thermoplastic elastomer tip, a sponge, and a plurality of tip bristles having a rounded profile.

12. The bottle brush set forth in claim 1, wherein the handle and the head are substantially collinear.

13. The bottle brush set forth in claim 1 further comprising a neck attached to the handle, wherein the head is removably coupled to the neck.

14. The bottle brush set forth in claim 1, wherein each bristle of the first row of bristles and the second rows of bristles is fixed to the barrel by one of a metal or plastic hold anchored or glued in the barrel.

15. The bottle brush set forth in claim 1, wherein the first angle is the same as the second angle.

16. The bottle brush set forth in claim 1, wherein the first angle is different than the second angle.

17. The bottle brush set forth in claim 1 further comprising a plurality of first rows of bristles positioned longitudinally intermediate the at least two second rows of bristles.

18. A bottle brush for use in cleaning a bottle comprising:

a handle; and a brush head connected to the handle and configured to be positioned within the bottle during cleaning, the brush head having a longitudinal axis and further comprising:

a barrel having a sidewall substantially parallel to the longitudinal axis, a first row of bristles extending from the sidewall, wherein the first row of bristles is biased a first angle from a plane normal to the longitudinal axis to extend from the sidewall at least in part transversely from the barrel and at least in part longitudinally to define a first bristle reach, the first bristle reach configured to facilitate engagement between the first row of bristles and a first feature of the bottle when the brush head is positioned within the bottle, and at least two second rows of bristles extending from the sidewall, wherein the at least two second rows of bristles are each biased a same second angle from the plane normal to the longitudinal axis to extend from the sidewall at least in part transversely from the barrel and at least in part longitudinally, each of the second rows of bristles defining a second bristle reach different from the first bristle reach, the second bristle reach configured to facilitate engagement between the second row of bristles and a second feature of the bottle when the brush head is positioned within the bottle, the at least two second rows of bristles being spaced longitudinally from each other with the first row of bristles being longitudinally intermediate the second rows of bristles.

* * * * *